US009244392B2

(12) United States Patent
Kuribayashi et al.

(10) Patent No.: US 9,244,392 B2
(45) Date of Patent: Jan. 26, 2016

(54) IMAGE FORMING APPARATUS WITH ORIENTED FLAKE SHAPE TONER

(71) Applicant: FUJI XEROX CO., LTD., Tokyo (JP)

(72) Inventors: Masataka Kuribayashi, Kanagawa (JP); Takafumi Koide, Kanagawa (JP); Katsuyuki Kitajima, Kanagawa (JP); Makoto Kamisaki, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/332,940

(22) Filed: Jul. 16, 2014

(65) Prior Publication Data

US 2015/0248081 A1 Sep. 3, 2015

(30) Foreign Application Priority Data

Mar. 3, 2014 (JP) ..... 2014-041008

(51) Int. Cl.
*G03G 15/16* (2006.01)
*G03G 15/00* (2006.01)

(52) U.S. Cl.
CPC ..... *G03G 15/1665* (2013.01); *G03G 15/657* (2013.01); *G03G 15/6585* (2013.01)

(58) Field of Classification Search
CPC ..... G03G 15/657; G03G 15/1665; G03G 15/1685
See application file for complete search history.

(56) References Cited

U.S. PATENT DOCUMENTS

2002/0106574 A1* 8/2002 Haneda et al. ..... 430/124

FOREIGN PATENT DOCUMENTS

JP A-2004-037996 2/2004

* cited by examiner

*Primary Examiner* — Clayton E Laballe
*Assistant Examiner* — Ruifeng Pu
(74) *Attorney, Agent, or Firm* — Oliff PLC

(57) ABSTRACT

An image forming apparatus includes a latent image forming unit that forms a latent image on a photoreceptor, a developing unit that accommodates a developer containing flake shape toner particles and develops the latent image using the developer to form a toner image on a surface of the photoreceptor, a transfer unit, a bias applying unit, and a fixing unit, wherein the flake shape toner particles have an average major axis length of from 7 μm to 20 μm and an average thickness of from 1 μm to 3 μm and contain a flake shape metallic pigment.

6 Claims, 4 Drawing Sheets

IMAGE FORMING APPARATUS WITH ORIENTED FLAKE SHAPE TONER

CROSS-REFERENCE TO RELATED APPLICATIONS

This application is based on and claims priority under 35 USC 119 from Japanese Patent Application No. 2014-041008 filed Mar. 3, 2014.

BACKGROUND

Technical Field

The present invention relates to an image forming apparatus.

SUMMARY

According to an aspect of the invention, there is provided an image forming apparatus including:

a latent image forming unit that forms a latent image on a photoreceptor;

a developing unit that accommodates a developer containing flake shape toner particles and develops the latent image using the developer to form a toner image on a surface of the photoreceptor;

a transfer unit that transfers the toner image formed on the surface of the photoreceptor onto a recording medium;

a bias applying unit that applies a bias voltage to the toner image transferred onto the recording medium such that major axis directions of the flake shape toner particles face substantially the same direction and such that the flake shape toner particles lie along a surface of the recording medium; and a fixing unit that fixes the toner image to which the bias voltage is applied, wherein the flake shape toner particles have an average major axis length of from 7 μm to 20 μm and an average thickness of from 1 μm to 3 μm and contain a flake shape metallic pigment.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described in detail with reference to the accompanying drawings.

Image Forming Apparatus

First, a major configuration of an image forming apparatus will be described.

Figure 1:
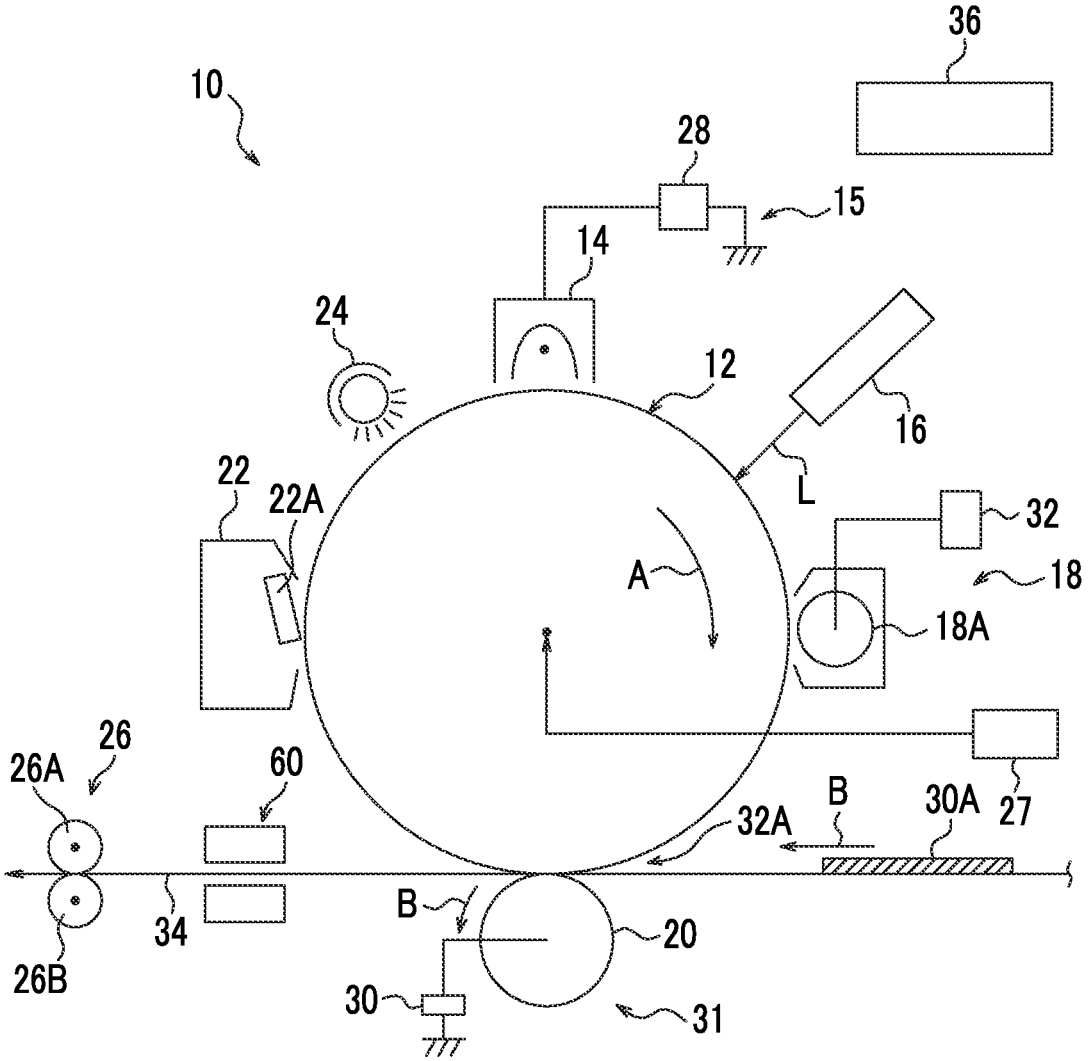
FIG. 1 is a schematic diagram illustrating an example of a configuration of an image forming apparatus according to an exemplary embodiment of the invention.

FIG. 1 is a schematic diagram illustrating an example of a configuration of an image forming apparatus according to an exemplary embodiment of the invention. As illustrated in FIG. 1, for example, the image forming apparatus 10 according to the exemplary embodiment is provided with an electrophotographic photoreceptor 12 (hereinafter, referred to as "photoreceptor"; an example of an image holding member). The photoreceptor 12 is cylindrical and is connected to a driving unit 27 such as a motor through a driving power transmitting member (not illustrated) such as a gear and is rotary driven by the driving unit 27 around a rotating shaft indicated by a black dot. In an example of FIG. 1, the photoreceptor 12 is rotary driven in a direction indicated by arrow A.

In the vicinity of the photoreceptor 12, for example, a charging device 15, a latent image forming device 16, a developing device 18, a transfer device 31, a cleaning device 22, and an erasing device 24 are arranged in order in the rotating direction of the photoreceptor 12. In the image forming apparatus 10 according to the exemplary embodiment, a bias applying device 60 and a fixing device 26 are arranged. The bias applying device 60 is arranged between the transfer device 31 and the fixing device 26. Hereinafter, the respective components of the image forming apparatus 10 will be described in detail.

Photoreceptor

For example, the photoreceptor 12 includes a conductive substrate, an undercoat layer that is formed on the conductive substrate, and a photosensitive layer that is formed on the undercoat layer. This photosensitive layer may be a two-layer structure including a charge generation layer and a charge transport layer. In addition, the photosensitive layer may have a configuration in which a protective layer is provided on the outermost surface. The undercoat layer includes a binder resin, metal oxide particle, and an electron accepting compound.

Charging Device

The charging device 15 charges a surface of the photoreceptor 12. The charging device 15 is provided in contact or non-contact with the surface of the photoreceptor 12 and includes a charging member 14 that charges the surface of the photoreceptor 12 and a power source 28 (an example of a voltage applying unit for the charging member) that applies a charging voltage to the charging member 14. The power source 28 is electrically connected to the charging member 14.

Examples of the charging member 14 of the charging device 15 include contact type chargers using a conductive charging roller, charging brush, charging film, charging rubber blade, charging tube or the like. In addition, other examples of the charging member 14 include non-contact roller chargers and well-known chargers such as a scorotron or corotron charger using corona discharge.

For example, the charging device 15 (including the power source 28) is electrically connected to a controller 36 provided in the image forming apparatus 10. The controller 36 controls the charging device 15 to apply a charging voltage to the charging member 14. The charging member 14 to which the charging voltage is applied from the power source 28 charges the photoreceptor 12 to a charging potential according to the applied charging voltage. Accordingly, when, the charging voltage applied from the power source 28 is adjusted, the photoreceptor 12 is charged to a different charging potential.

Latent Image Forming Device

The latent image forming device 16 (an example of a latent image forming unit) forms an electrostatic latent image on the charged surface of the photoreceptor 12. Specifically, for example, the latent image forming device 16 is electrically connected to the controller 36 provided in the image forming apparatus 10. The controller 36 controls the latent image forming device 16 to irradiate the surface of the photoreceptor 12, which is charged by the charging member 14, with light L modulated based on image information of an image to be formed. As a result, an electrostatic latent image corresponding to the image of the image information is formed on the photoreceptor 12.

Examples of the latent image forming device 16 includes optical devices having a light source which emits semiconductor laser light, LED light, liquid crystal shutter light, or the like according to an image shape.

Developing Device

For example, the developing device 18 is provided on a downstream of a position, which is irradiated with the light L by the latent image forming device 16, in the rotating direction of the photoreceptor 12. An accommodating unit which accommodates a developer is provided inside the developing device 18. In the exemplary embodiment, this accommodating unit accommodates "a developer containing a brilliant toner" described below. For example, the brilliant toner is accommodated in a state of being charged in the developing device 18. "The developer containing a brilliant toner" will be described below.

For example, the developing device 18 includes: a developing member 18A that develops the electrostatic latent image formed on the surface of the photoreceptor 12 using the developer containing the toner; and a power source 32 (an example of a voltage applying unit for the developing member) that applies a developing voltage to the developing member 18A. For example, this developing member 18A is electrically connected to the power source 32.

The developing member 18A of the developing device 18 is selected according to the type of the developer, and examples thereof include a developing roll that includes a developing sleeve which covers a magnet.

For example, the developing device 18 (including the power source 32) is electrically connected to the controller 36 provided in the image forming apparatus 10. The controller 36 controls the developing device 18 to apply the developing voltage to the developing member 18A. The developing member 18A to which the developing voltage is applied is charged to a developing potential according to the developing voltage. For example, the developing member 18A charged to the developing potential holds the developer, which is accommodated inside the developing device 18, on the surface and supplies the toner contained in the developer from the inside of the developing device 18 to the surface of the photoreceptor 12.

For example, the toner supplied onto the photoreceptor 12 is attached onto the electrostatic latent image formed on the photoreceptor 12 by an electrostatic force. Specifically, for example, the toner contained in the developer is supplied to a region of the photoreceptor 12 where the electrostatic latent image is formed due to a potential difference of a region where the photoreceptor 12 and the developing member 18A face each other, that is, due to a potential difference of the region between the potential of the surface of the photoreceptor 12 and the developing potential of the developing member 18A. When the developer contains a carrier, the carrier returns to the developing device 18 while being held by the developing member 18A.

For example, the electrostatic latent image on the photoreceptor 12 is developed by the toner supplied from the developing member 18A to form a toner image corresponding to the electrostatic latent image on the photoreceptor 12.

Transfer Device

For example, the transfer device 31 is provided on a downstream side of the developing member 18A in the rotating direction of the photoreceptor 12. For example, the transfer device 31 includes: a transfer member 20 that transfers the toner image formed on the surface of the photoreceptor 12 onto a recording medium 30A (an example of a transfer medium); and a power source 30 (an example of a voltage applying unit for the transfer member) that applies a transfer voltage to the transfer member 20. For example, the transfer member 20 has a cylindrical shape, and the recording medium 30A is transported while being interposed between the transfer member 20 and the photoreceptor 12. For example, the transfer member 20 is electrically connected to the power source 30.

Examples of the transfer member 20 of the transfer device 31 includes contact type transfer chargers using a belt, roller, film, rubber blade, or the like; and well-known non-contact type transfer chargers such as a scorotron or corotron charger using corona discharge.

For example, the transfer device 31 (including the power source 30) is electrically connected to the controller 36 provided in the image forming apparatus 10. The controller 36 controls the transfer device 31 to apply a transfer voltage to the transfer member 20. The transfer member 20 to which the transfer voltage is applied is charged to a transfer potential according to the transfer voltage.

When the transfer voltage having a polarity opposite to that of the toner, which is included in the toner image formed on the photoreceptor 12, is applied from the power source 30 of the transfer device 31 to the transfer member 20, a transfer electric field having a field intensity is formed in, for example, a region (refer to a transfer region 32A in FIG. 1) where the photoreceptor 12 and the transfer member 20 face each other. As a result, the toner included in the toner image on the photoreceptor 12 is transported from the photoreceptor 12 to the transfer member 20 by an electrostatic force.

The recording medium 30A (an example of the transfer medium) is accommodated in an accommodating unit (not illustrated), is transported from the accommodating unit through plural transport members (not illustrated) along a feeding path 34, and reaches the transfer region 32A where the photoreceptor 12 and the transfer member 20 face each other. In the example of FIG. 1, the recording medium 30A is transported in a direction indicated by arrow B. For example, the toner image on the photoreceptor 12 is transferred onto the recording medium 30A, which reaches the transfer region 32A, due to the transfer electric field which is formed in the above-described region by the transfer voltage being applied to the transfer member 20. That is, for example, the toner image is transferred onto the recording medium 30A by the toner moving from the surface of the photoreceptor 12 to the recording medium 30A.

Cleaning Device

The cleaning device 22 is provided on a downstream side of the transfer region 32A in the rotating direction of the photoreceptor 12. The cleaning device 22 removes materials attached on the photoreceptor 12 after the toner image is transferred onto the recording medium 30A. The cleaning device 22 removes materials, such as residual toner or paper powder, attached on the photoreceptor 12. In the exemplary embodiment, the cleaning device 22 includes a plate-shape member 22A (hereinafter, referred to as "cleaning blade")

that is in contact with the photoreceptor 12 under a predetermined linear pressure. The cleaning blade 22A is in contact with the photoreceptor 12 under a linear pressure of, for example, from 10 g/cm to 150 g/cm.

Erasing Device

For example, the erasing device 24 (an example of an erasing unit) is provided on a downstream side of the cleaning device 22 in the rotating direction of the photoreceptor 12. The erasing device 24 exposes the surface of the photoreceptor to be erased after the toner image is transferred. Specifically, for example, the erasing device 24 is electrically connected to the controller 36 provided in the image forming apparatus 10. The controller 36 controls the erasing device 24 to expose the entire surface of the photoreceptor 12 (specifically, the entire surface of an image forming region) to be erased.

Examples of the erasing device 24 include devices having a light source such as a tungsten lamp which emits white light or a light emitting diode (LED) which emits red light.

Bias Applying Device

For example, the bias applying device 60 is provided on a downstream side of the transfer region 32A in a transport direction of the recording medium 30A on the feeding path 34. For example, the bias applying device 60 applies a bias voltage to the toner image transferred onto the recording medium 30A.

Examples of the bias applying device 60 include a well-known scorotron or corotron transfer charger and a conductive electrode plate that generates an electric field with the surface of the photoreceptor. A potential applied by the bias applying device 60 may be a DC component, an AC component, or a component in which an AC component is superimposed on a DC component. A voltage applied to the bias applying device 60 is preferably in a range from ±200 V to ±500 V.

The recording medium 30A onto which the toner image is transferred by being transported along the feeding path 34 and passing through the region (transfer region 32A) where the photoreceptor 12 and the transfer member 20 face each other, reaches a installation position of the bias applying device 60 along the feeding path 34 through, for example, a transport member (not illustrated), and the bias voltage is applied thereto. A specific configuration example will be described.

Figure 2A:
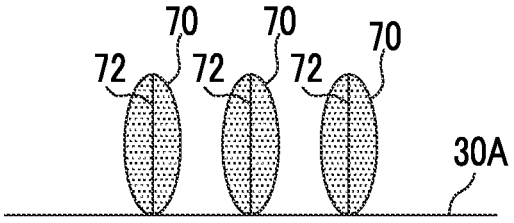
FIGS. 2A and 2B are schematic diagrams illustrating a state of brilliant toner particles transferred onto a recording medium.
Figure 2B:
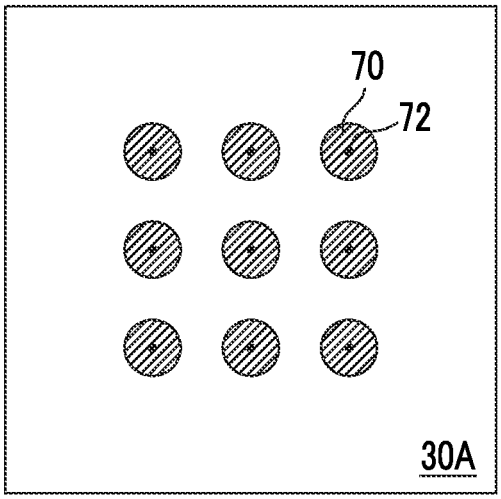

FIGS. 2A and 2B are schematic diagrams illustrating a state of brilliant toner particles transferred onto the recording medium. As described below, brilliant toner particles 70 are flake shape and have major axes 72. When the transfer electric field is applied, the flake shape toner particles are polarized and aligned such that major axis directions of the brilliant toner particles 70 face a direction of the transfer electric field. That is, the brilliant toner particles 70 have a major axis direction intersecting with the surface of the recording medium 30A and rise from the surface of the recording medium 30A.

Figure 3A:
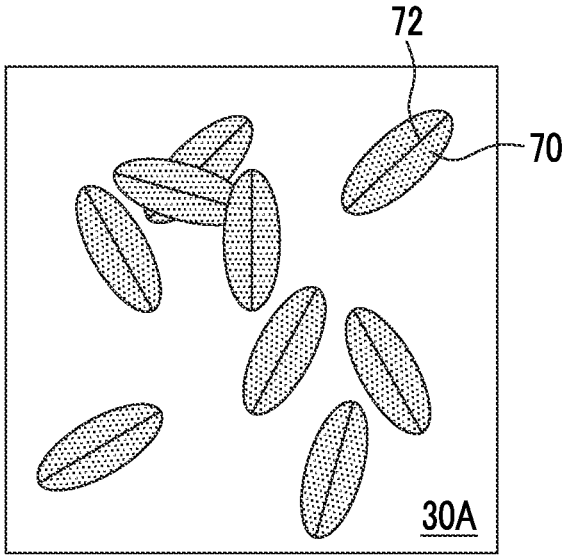
FIG. 3A is a schematic diagram illustrating a state of brilliant toner particles when being fixed without a bias voltage being applied thereto.

FIG. 3A is a schematic diagram illustrating a state of the brilliant toner particles when being fixed without the bias voltage being applied thereto. When the brilliant toner particles 70 are fixed while rising from the surface of the recording medium 30A, as illustrated in FIG. 3A, the brilliant toner particles 70 are fixed in a state where the major axis directions of the brilliant toner particles 70 are scattered. In this state, it is presumed that the brilliance of the brilliant toner is not sufficiently exhibited.

On the other hand, the bias applying device 60 applies the bias voltage to the toner image transferred onto the recording medium 30A such that the respective major axis directions of the flake shape brilliant toner particles match with each other and such that the respective flake shape brilliant toner particles lie along the surface of the recording medium 30A. The brilliance of the image (fixed image) formed on the recording medium is improved by the bias voltage being applied.

Figure 3B:
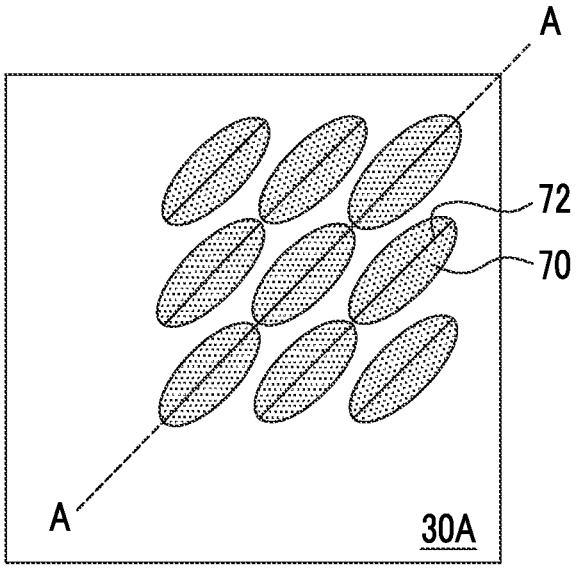
FIGS. 3B and 3C are schematic diagrams illustrating a state of brilliant toner particles when being fixed after a bias voltage being applied thereto.
Figure 3C:
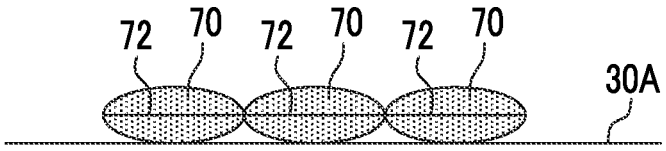

FIG. 3B is a schematic diagram illustrating a state of the brilliant toner particles when being fixed after the bias voltage being applied thereto. FIG. 3C is a cross-sectional view taken along line IIIC-IIIC of FIG. 3B. As illustrated in FIGS. 3B and 3C, it is presumed that, by the bias voltage being applied thereto, the brilliant toner particles 70 which rise from the surface of the recording medium 30A lie such that the directions of the major axes 72 match with each other; as a result the brilliance of the brilliant toner is sufficiently exhibited.

Figure 4:
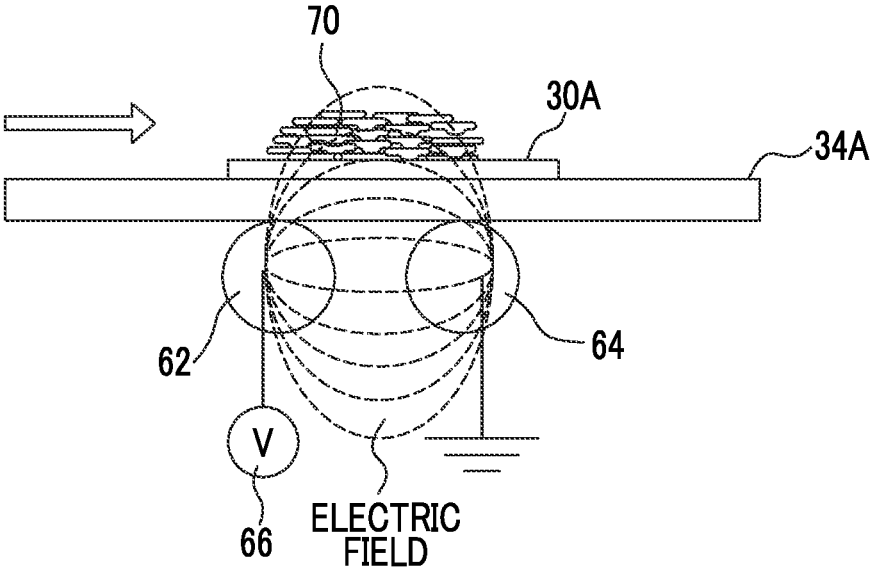
FIG. 4 is a schematic diagram illustrating a configuration example of a bias applying device.

FIG. 4 is a schematic diagram illustrating a configuration example of the bias applying device 60. The bias applying device 60 includes a first transport roller 62, a second transport roller 64, and a power source 66. The first transport roller 62 and the second transport roller 64 are arranged to contact with a back surface side of a transport belt 34A which is arranged along the feeding path 34. In this case, a surface of the transport belt 34A on which the recording medium 30A is placed is a front surface, and an opposite surface thereof is a back surface. The transport direction is indicated by an arrow. The second transport roller 64 is arranged on a downstream side of the first transport roller 62 in the transport direction.

When a voltage is applied between the first transport roller 62 and the second transport roller 64 by the power source 66, an electric field indicated by a dotted line is generated between the first transport roller 62 and the second transport roller 64. While the recording medium 30A is transported and passes between the first transport roller 62 and the second transport roller 64, the flake shape brilliant toner particles 70 on the recording medium 30A are laid along the surface of the recording medium 30A by the electric field generated between the transport rollers.

Fixing Device

The fixing device 26 is arranged on a downstream side of the bias applying device 60 in the transport direction of the recording medium 30A on the feeding path 34. For example, the fixing device 26 fixes the toner image transferred onto the recording medium 30A. For example, the fixing device 26 is electrically connected to the controller 36 provided in the image forming apparatus 10. The controller 36 controls the fixing device 26 to fix the toner image, which is transferred onto the recording medium 30A, on the recording medium 30A with heat or with heat and pressure.

Examples of the fixing device 26 include a well-known fixing unit such as a heat roller fixing unit or an oven fixing unit. FIG. 1 illustrates a heat roller fixing unit as the fixing device 26. The fixing device 26 which is the heat roller fixing unit includes a heating roll 26A and a pressure roll 26B that is arranged opposite to the heating roll 26A. The recording medium 30A onto which the toner image is transferred is nipped between the heating roll 26A and the pressure roll 26B which rotate in opposite directions and is heated and pressed.

The heating roll 26A and the pressure roll 26B may rotate in opposite directions at different peripheral speeds. By rotating the heating roll 26A and the pressure roll 26B at different peripheral speeds, the toner image slides thereon, and the brilliant toner particles lie along the surface of the recording medium 30A. For example, the pressure roll 26B rotates at a peripheral speed which is 1.03 times faster than that of the heating roll 26A. The difference between the peripheral speeds is preferably from 0.95 time to 1.05 times and more preferably from 0.97 time to 1.03 times.

Image Forming Operation

Here, an image forming operation of the image forming apparatus 10 will be described.

First, the surface of the photoreceptor 12 is charged by the charging device 15. The latent image forming device 16 exposes the charged surface of the photoreceptor 12 based on image information. As a result, an electrostatic latent image corresponding to the image information is formed on the photoreceptor 12. In the developing device 18, the electrostatic latent image formed on the surface of the photoreceptor 12 is developed by the developer containing the brilliant toner. As a result, a toner image is formed on the surface of the photoreceptor 12.

In the transfer device 31, the toner image formed on the surface of the photoreceptor 12 is transferred onto the recording medium 30A. The bias voltage is applied to the toner image transferred onto the recording medium 30A by the bias applying device 60. Due to the application of the bias voltage, the flake shape brilliant toner particles are laid on the surface of the recording medium 30A such that the major axis directions match with each other. The toner image transferred onto the recording medium 30A is fixed by the fixing device 26 in a state where the flake shape brilliant toner particles are laid.

By forming the image using the brilliant toner as described, the image having metallic luster is formed on the recording medium 30A. In the state where the flake shape brilliant toner particles are laid, the toner image transferred onto the recording medium 30A is fixed. As a result, the brilliance of the image having metallic luster is improved. The recording medium 30A on which the image is formed by fixing the toner image is discharged to the outside of the image forming apparatus 10 by plural transport members (not illustrated).

On the other hand, after the toner image is transferred, the surface of the photoreceptor 12 is cleaned by the cleaning device 22 and erased by the erasing device 24. After being erased by the erasing device 24, the photoreceptor 12 is charged again to the charging potential by the charging device 15.

Developer Containing Brilliant Toner

Next, the brilliant toner according to the exemplary embodiment will be described.

Summary of Brilliant Toner

The brilliant toner according to the exemplary embodiment (hereinafter, simply referred to as "brilliant toner") contains toner particles containing a metallic pigment. The brilliant toner reflects light and exhibits brilliance by containing the toner particles containing a metallic pigment. "The brilliance" described herein represents brilliance such as metallic luster which is exhibited when an image formed using the brilliant toner according to the exemplary embodiment is visually recognized.

As described below, the metallic pigment has a large particle diameter and a flake shape (strip shape). Therefore, the toner particles containing the metallic pigment are also flake shape. In the exemplary embodiment, the toner particles containing the metallic pigment contain the flake shape metallic pigment and have an average major axis length of from 7 μm to 20 μm and an average thickness of from 1 μm to 3 μm. The shape of the metallic pigment and the shape of the toner particles containing the metallic pigment will be described below in detail.

Brilliance

Here, "brilliance" will be described in more detail.

In the brilliant toner, when a solid image is formed, and when a reflectance of incident light with which the solid image is irradiated at an incident angle of −45° is measured by a variable angle photometer, it is preferable that a ratio (A/B) of a reflectance A at a light receiving angle of +30° to a reflectance B at a light receiving angle of −30° be from 2 to 100.

The ratio (A/B) of 2 or higher implies that the intensity of light reflected to a side (+angle side) opposite to the incident side is higher than that reflected to an incident side (−angle side) of the incident light and implies that the diffused reflection of the incident light is suppressed. In a case where the diffused reflection in which the incident light is reflected in various directions occurs, when the reflected light is visually recognized, the color thereof appears to be dull. Therefore, in a case where the ratio (A/B) is lower than 2, even when the reflected light is visually recognized, the luster cannot be seen and the brilliance may be poor.

On the other hand, when the ratio (A/B) is higher than 100, a viewing angle at which the reflected light can be visually recognized is narrowed too much, and the amount of specular reflection light components is large. Therefore, the reflected light may appear to be dark depending on the viewing angle. In addition, it is difficult to prepare a toner having the ratio (A/B) of higher than 100.

The ratio (A/B) is more preferably from 50 to 100, still more preferably from 60 to 90, and even still more preferably from 70 to 80.

Measurement of Ratio (A/B) using Variable Angle Photometer

Here, first, the incident angle and the light receiving angle will be described. The reason for setting the incident angle to −45° C. during the measurement using the variable angle photometer in the exemplary embodiment is that the measurement sensitivity is high for an image having a wide brilliance range. In addition, the reason for setting the light receiving angle to −30° and +30° is that the measurement sensitivity is highest for evaluating an image having brilliance and an image having no brilliance.

Next, a method of measuring the ratio (A/B) will be described.

In the exemplary embodiment, first, "solid image" is formed using the following method during the measurement of the ratio (A/B). A developing unit of DocuCentre-III C7600 (manufactured by Fuji Xerox Co., Ltd.) is filled with a sample of the developer, and a solid image is formed on recording paper (OK Topcoat+, manufactured by Oji Paper Co., Ltd.) under conditions of a fixing temperature of 190° C., a fixing pressure of 4.0 kg/cm$^2$, and a toner applied amount of 4.5 g/cm$^2$. "The solid image" refers to an image having a coverage rate of 100%.

An image portion of the formed solid image is irradiated with incident light at an incident angle of −45° using a variable angle spectrophotometer GC5000L (manufactured by Nippon Denshoku Industries Co., Ltd.) to measure the reflectance A at a light receiving angle of +30° and the reflectance B at a light receiving angle of −30°. The reflectance A and the reflectance B are obtained through measurement of light having a wavelength range of 400 nm to 700 nm at intervals of 20 nm, as average values of the reflectance at each wavelength. The ratio (A/B) is calculated from these measurement results.

Toner Composition

Next, the composition of the brilliant toner will be described.

The brilliant toner contains the toner particles containing the metallic pigment. In addition, optionally, the brilliant toner may contain an external additive. The toner particles containing the metallic pigment contain the metallic pigment and a binder resin. In addition, optionally, the toner particles may contain a release agent and other additives. Hereinafter, the metallic pigment, the binder resin, the release agent, and other additives will be described.

Metallic Pigment

Examples of the metallic pigment used in the exemplary embodiment include metal powder of aluminum, brass, bronze, nickel, zinc, or the like. In addition, a coated pigment may be used in which the surface of the metallic pigment is coated at least one metal oxide selected from the group consisting of silica, alumina and titania.

Among these, a pigment containing aluminum (Al) is preferable as the metallic pigment from the viewpoint of being available and easily obtaining a flake shape. When the pigment containing Al as the metallic pigment is used, the Al content in the metallic pigment is preferably from 40% by weight to 100% by weight and more preferably from 60% by weight to 98% by weight.

The average major axis length and the average thickness of the metallic pigment are preferably from 5 μm to 12 μm and from 0.01 μm to 0.5 μm, respectively. The major axis of the metallic pigment refers to the longest portion of the metallic pigment when being observed from the thickness direction thereof.

When the average major axis length of the metallic pigment is less than 5 μm, it may be difficult for the brilliant toner to exhibit brilliance. When the average major axis length of the metallic pigment is more than 12 μm, it may be difficult to manufacture the toner. The average major axis length of the metallic pigment is preferably from 5 μm to 12 μm and more preferably from 5 μm to 9 μm.

In addition, when the average thickness of the metallic pigment is less than 0.01 μm, brilliance may decrease due to the deformation and shrinkage of the metallic pigment. When the average thickness of the metallic pigment is more than 0.5 μm, it may be difficult for the brilliant toner to exhibit brilliance. The average thickness of the metallic pigment is preferably from 0.01 μm to 0.5 μm and more preferably from 0.01 μm to 0.3 μm.

In the exemplary embodiment, the average major axis length and the average thickness of the metallic pigment are values which are measured and calculated from images obtained from a magnified photograph of 50 pigment particles taken by using a scanning electron microscope (SEM).

The content of the metallic pigment in the brilliant toner is preferably from 1 part by weight to 70 parts by weight and more preferably from 5 parts by weight to 50 parts by weight with respect to 100 parts by weight of the binder resin described below.

Binder Resin

Examples of the binder resin include vinyl-based resins formed of homopolymers of the following monomers or copolymers obtained by combining two or more kinds of the monomers, the monomers including styrenes (for example, styrene, p-chlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene).

Examples of the binder resin include non-vinyl-based resins such as epoxy resins, polyester resins, polyurethane resins, polyamide resins, cellulose resins, polyether resins, and modified rosin; mixtures thereof with the above-described vinyl-based resins; and graft polymers obtained by polymerizing a vinyl-based monomer with the coexistence of such non-vinyl-based resins. These binder resins may be used alone or in combination of two or more kinds thereof.

As the binder resin, a polyester resin is preferable. Examples of the polyester resin include well-known polyester resins. Examples of the polyester resin include a condensation polymer of a polyvalent carboxylic acid and a polyol. As an amorphous polyester resin, a commercially available product or a synthesized product may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, and lower alkyl esters (having, for example, from 1 to 5 carbon atoms) thereof. Among these, for example, aromatic dicarboxylic acids are preferable as the polyvalent carboxylic acid.

As the polyvalent carboxylic acid, a combination of a tri- or higher-valent carboxylic acid employing a crosslinked structure or a branched structure with a dicarboxylic acid may be used. Examples of the tri- or higher-valent carboxylic acid include trimellitic acid, pyromellitic acid, anhydrides thereof, and lower alkyl esters (having, for example, from 1 to 5 carbon atoms) thereof. The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferable, and aromatic diols are more preferable as the polyol.

As the polyol, a combination of a tri- or higher-valent polyol employing a crosslinked structure or a branched structure with diol may be used. Examples of the tri- or higher-valent polyol include glycerin, trimethylolpropane, and pentaerythritol. The polyols may be used alone or in combination of two or more kinds thereof.

The glass transition temperature (Tg) of the polyester resin is preferably from 50° C. to 80° C., and more preferably from 50° C. to 65° C. The glass transition temperature is obtained from a DSC curve obtained by differential scanning calorimetry (DSC). More specifically, the glass transition temperature is obtained from the "extrapolated glass transition onset temperature" described in the method of obtaining a glass transition temperature in the "testing methods for transition temperatures of plastics" in JIS K7121-1987.

The weight average molecular weight (Mw) of the polyester resin is preferably from 5,000 to 1,000,000, and more preferably from 7,000 to 500,000. The number average molecular weight (Mn) of the polyester resin is preferably from 2,000 to 100,000. The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using HLC-8120 (GPC manufactured by Tosoh Corporation) as a measuring device, TSK gel Super HM-M (column manufactured by Tosoh Corporation; 15 cm), and a THF solvent. The weight average molecular weight and the number average molecular weight are calculated using a molecular weight calibration curve plotted from a monodisperse polystyrene standard sample from the results of the above measurement.

Examples of a method of preparing the polyester resin include a well-known method, specifically, a method of setting a polymerization temperature to be in a range from 180° C. to 230° C., optionally reducing the internal pressure of the reaction system, and causing a reaction while removing water or an alcohol generated during condensation.

When monomers of the raw materials are not soluble or compatible with each other at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be preliminarily condensed and then polycondensed with the major component.

For example, in the toner particles containing the metallic pigment, the content of the binder resin is preferably from 40% by weight to 95% by weight, more preferably from 50% by weight to 90% by weight, and even more preferably from 60% by weight to 85% by weight with respect to all the toner particles.

Release Agent

Examples of the release agent include hydrocarbon-based waxes; natural waxes such as carnauba wax, rice wax, and candelilla wax; synthetic or mineral/petroleum-based waxes such as montan wax; and ester-based waxes such as fatty acid esters and montanic acid esters. The release agent is not limited to these examples.

The melting temperature of the release agent is preferably from 50° C. to 110° C., and more preferably from 60° C. to 100° C. The melting temperature is obtained from the "melting peak temperature" described in the method of obtaining a melting temperature in the "testing methods for transition temperatures of plastics" in JIS K7121:1987, based on a DSC curve obtained by differential scanning calorimetry (DSC).

The content of the release agent is, for example, preferably from 1% by weight to 20% by weight, and more preferably from 5% by weight to 15% by weight with respect to all the toner particles.

Other Additives

Examples of other additives include well-known additives such as a magnetic material, a charge-controlling agent, and inorganic powder. The toner particles include these additives as internal additives.

Shape of Toner Particles

Next, the shape of the toner particles will be described. As described above, the toner particles containing the metallic pigment has "a flake shape" which is dependent on the shape of the metallic pigment.

The toner particles containing the metallic pigment (hereinafter, referred to as "brilliant toner particles" in the description of the toner shape) have an average major axis length of from 7 μm to 20 μm and an average thickness of from 1 μm to 3 μm.

The average major axis length and the average thickness of the brilliant toner particles are preferably from 7 μm to 20 μm and from 1 μm to 3 μm, respectively. The major axis of the brilliant toner particle refers to the longest portion of the brilliant toner particle when being observed from the thickness direction thereof.

When the average major axis length of the brilliant toner particles is less than 7 μm, brilliance may deteriorate. When the average major axis of the brilliant toner particles is more than 20 μm, image graininess may deteriorate. The average major axis length of the brilliant toner particles is preferably from 7 μm to 20 μm and more preferably from 8 μm to 15 μm.

In addition, when the average thickness of the brilliant toner particles is less than 1 μm, the fluidity of the brilliant toner particles may deteriorate. When the average thickness of the brilliant toner particles is more than 3 μm, brilliance may deteriorate due to arrangement fluctuation. The average thickness of the brilliant toner particles is preferably from 1 μm to 3 μm.

In the exemplary embodiment, the average major axis length and the average thickness of the brilliant toner particles are values which are measured and calculated from images obtained from a magnified photograph of 100 brilliant toner particles taken by using an SEM.

The average circularity of the brilliant toner particles is preferably from 0.5 to 0.9. When the average circularity of the brilliant toner particles is less than 0.5, image graininess may deteriorate. When the average circularity of the brilliant toner particles is more than 0.9, cleaning failure may occur due to the rolling property of the brilliant toner particles. The average circularity of the brilliant toner particles is more preferably from 0.5 to 0.9 and still more preferably from 0.5 to 0.8.

In the exemplary embodiment, the average circularity of the brilliant toner particles is measured using FPIA-3000 (manufactured by Sysmex Corporation) as a flow particle image analyzer. As a specific measurement method, from 0.1 ml to 0.5 ml of a surfactant (alkylbenzene sulfonate) as a dispersant is added to from 100 ml to 150 ml of water in which solid impurities are removed in advance, and from 0.1 g to 0.5 g of a measurement sample is further added thereto. A suspension in which the measurement sample is dispersed is dispersed with an ultrasonic disperser for 1 minute to 3 minutes such that the concentration of the dispersion is from 3,000 particles/μl to 10,000 particles/μl. Then, the circularity of the brilliant toner particles is measured using the above-described analyzer. The circularity is calculated from the following expression. Circularity=Perimeter of Equivalent Circle Diameter/Peripheral Length=$[2\times(A\pi)^{1/2}]/PM$ In the expression, A represents a projected area, and PM represents a perimeter.

The circularity is obtained from the above expression, and the average value thereof is obtained as the average circularity.

The volume average particle size of the brilliant toner particles is preferably from 1 μm to 30 μm and more preferably from 3 μm to 20 μm.

The volume average particle size is obtained as follows. Volume and number cumulative distributions are plotted from the smallest diameter side in particle size ranges (channels) divided based on a particle size distribution which is measured with a measurement instrument such as MULTISIZER II (manufactured by Beckman Coulter Inc.). Particle sizes having a cumulative value of 16% are defined as a cumulative volume average particle size $D_{16v}$ and a cumulative number average particle size $D_{16p}$, particle sizes having a cumulative value of 50% are defined as a cumulative volume average particle size $D_{50v}$ and a cumulative number average particle size $D_{50p}$, and particle sizes having a cumulative value of 84% are defined as a cumulative volume average particle size $D_{84v}$ and a cumulative number average particle size $D_{84p}$. Using these values, a volume average particle size distribution index (GSDv) is calculated from $(D_{84v}/D_{16v})^{1/2}$.

Method of Preparing Toner

The brilliant toner may be prepared by preparing toner particles and adding an external additive to the toner particles. A method of preparing toner particles is not particularly limited. The toner particles are prepared using a well-known method such as a dry method (for example, a kneading and pulverizing method) or a wet method (for example, an emulsion aggregating method or a dissolution suspension method).

Developer

The developer according to the exemplary embodiment contains at least the above-described brilliant toner. The developer may be a single-component developer containing only the brilliant toner or may be a two-component developer containing the brilliant toner and a carrier.

The carrier is not particularly limited, and a well-known carrier may be used. Examples of the carrier include a coated carrier in which a core surface formed of magnetic powder is coated with a coating resin; a magnetic powder-dispersed carrier in which magnetic powder is dispersed and blended in a matrix resin; and a resin-impregnated carrier in which porous magnetic powder is impregnated with resin. The magnetic powder-dispersed carrier and the resin-impregnated carrier may be carriers including: constituent particles of the carrier as a core; and a coating resin for coating the constituent particles of the carrier.

Examples of the magnetic powder include magnetic metals such as iron oxide, nickel, or cobalt; and magnetic oxides such as ferrite or magnetite. Examples of the conductive particles include particles of metals such as gold, silver, or copper and particles of carbon black, titanium oxide, zinc oxide, tin oxide, barium sulfate, aluminum borate, potassium titanate, or the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin containing an organosiloxane bond or modified products thereof, a fluororesin, polyester, polycarbonate, a phenol resin, and an epoxy resin. The coating resin and the matrix resin may contain other additives such as a conductive material.

Examples of a method of coating the core surface with the coating resin include a coating method using a coating layer-forming solution in which the coating resin and optionally various additives are dissolved or dispersed in an appropriate solvent. The solvent is not particularly limited and may be selected in consideration of the coating resin used, the coating aptitude, and the like.

Specific examples of the resin coating method include a dipping method of dipping the core in the coating layer-forming solution; a spray method of spraying the coating layer-forming solution on the core surface; a fluid bed method of spraying the coating layer-forming solution on the core surface while making the core float with flowing air; and a kneader coater method of mixing the core of the carrier with the coating layer-forming solution in a kneader coater and removing a solvent.

In the two-component developer, a mixing ratio (weight ratio; toner:carrier) of the brilliant toner to the carrier is preferably from 1:100 to 30:100 and more preferably from 3:100 to 20:100.

The configurations of the image forming apparatus described in the above-described exemplary embodiment are merely exemplary. It is needless to say that these configurations may be modified within a range not departing from the gist of the present invention.

For example, in the above-described exemplary embodiment, the monochrome image forming apparatus including the developing device that accommodates the developer containing the brilliant toner have been described, but the configuration of the image forming apparatus is not limited thereto. A tandem type image forming apparatus including plural image forming units may be adopted, in which each of the image forming units includes the developing device that accommodates the developer containing the brilliant toner.

In addition, an image forming apparatus may be adopted in which a toner image is primarily transferred from the photoreceptor to an intermediate transfer member and then is secondarily transferred onto the recording medium. In this case, the brilliance of an image formed on the recording medium is improved by applying a bias voltage to the toner image which is secondarily transferred onto the recording medium.

EXAMPLES

Hereinafter, the exemplary embodiment will be described in detail using Examples and Comparative Examples but is not limited to the following examples. Unless specified otherwise, "part(s)" and "%" represent "part(s) by weight" and "% by weight".

Synthesis of Binder Resin

Dimethyl adipate: 74 parts
Dimethyl terephthalate: 192 parts
Ethylene oxide adduct of bisphenol A: 216 parts
Ethylene glycol: 38 parts
Tetrabutoxy titanate (catalyst): 0.037 part The above-described components are put into a heated and dried two-necked flask, are held in an inert atmosphere by introducing nitrogen gas into the container, and are heated under stirring, followed by a copolycondensation reaction at 160° C. for 7 hours. Next, the mixture is heated to 220° C. and held for 4 hours while slowly reducing the pressure to 10 Torr. After temporarily returning the pressure to normal pressure, 9 parts of trimellitic anhydride is added to the mixture, the pressure is slowly reduced to 10 Torr again, and the mixture is held at 220° C. for 1 hour. As a result, a binder resin is synthesized.

The glass transition temperature (Tg) of the binder resin is measured according to ASTMD3418-8 using a differential scanning calorimeter (DSC-50, manufactured by Shimadzu Corporation) in a temperature range from room temperature (25° C.) to 150° C. at a temperature increase rate of 10° C./min. The glass transition temperature is a temperature at an intersection between a base line and an extended line of a rising line in an endothermic portion. The glass transition temperature of the binder resin is 63.5° C.

Preparation of Resin Particle Dispersion

Binder resin: 160 parts
Ethyl acetate: 233 parts
Aqueous sodium hydroxide solution (0.3 N): 0.1 part The above-described components are put into a 1000 ml separable flask, are heated to 70° C., and are stirred with THREE-ONE MOTOR (manufactured by Shinto Scientific Co., Ltd.). As a result, a resin mixed solution is prepared. This resin mixed solution is further stirred at 90 rpm, and 373 parts of ion exchange water is slowly added thereto, followed by phase-transfer emulsification and solvent removal. As a result, a resin particle dispersion (solid content concentration: 30%) is obtained. The volume average particle size of the resin particle dispersion is 162 nm.

Preparation of Release Agent Dispersion

Carnauba wax (RC-160, manufactured by Toa Kasei Co., Ltd.): 50 parts

Anionic surfactant (NEOGEN RK, manufactured by Dai-Ichi Kogyo Seiyaku Co., Ltd.): 1.0 part Ion exchange water: 200 parts A mixture of the above-described components is heated to 95° C. and is dispersed with a homogenizer (ULTRA TURRAX T50, manufactured IKA Corporation), followed by dispersing with a Manton-Gaulin high-pressure homogenizer (manufactured by Gaulin) for 360 minutes. As a result, a release agent dispersion (solid concentration: 20%) in which release agent particles having a volume average particle size of 0.23 μm is dispersed is prepared.

Preparation of Metallic Pigment Particle Dispersion

Aluminum pigment (2173EA, manufactured by Showa Aluminum Powder K.K): 100 parts

Anionic surfactant (NEOGEN R, manufactured by Dai-Ichi Kogyo Seiyaku Co., Ltd.): 1.5 parts Ion exchange water: 900 parts After a solvent is removed from a paste of the aluminum pigment, the above-described components are mixed, are dissolved, and are dispersed with an emulsifying disperser CAVITRON (CR1010, manufactured by Pacific Machinery&Engineering Co., Ltd.) for about 1 hour. As a result, a metallic pigment particle dispersion (solid concentration: 10%) in which metallic pigment particles (aluminum pigment) are dispersed is prepared. The average major axis length of the aluminum pigment (metallic pigment) is 8 μm and the average thickness thereof is 0.1 μm.

Preparation of Toner

Resin particle dispersion: 380 parts

Release agent dispersion: 72 parts

Metallic pigment particle dispersion: 140 parts

The metallic pigment particle dispersion, the resin particle dispersion, and the release agent dispersion are put into a 2 L cylindrical stainless steel container and are dispersed and mixed with a homogenizer (ULTRA TURRAX T50, manufactured IKA Corporation) for 10 minutes while applying a shearing force thereto at 4000 rpm. Next, 1.75 parts of 10% aqueous nitric acid solution of polyaluminum chloride as a coagulant is slowly added dropwise to the mixed dispersion, and the mixed dispersion is dispersed and mixed with a homogenizer at a rotating speed 5000 rpm for 15 minutes. As a result, a raw material dispersion is obtained.

Next, the raw material dispersion is poured to a polymerization kettle including a stirring device with two-paddle stirring blades and a thermometer and is heated to 54° C. with a mantle heater at a stirring rotating speed of 810 rpm. Aggregated particles are grown at 54° C. In addition, at this time, the pH of the raw material dispersion is controlled to a range of from 2.2 to 3.5 using 0.3 N nitric acid and 1 N aqueous sodium hydroxide solution. The raw material dispersion is held in the above-described pH range for about 2 hours, and aggregated particles are formed.

Next, the resin particle dispersion is additionally added such that the resin particles of the binder resin are attached on surfaces of the aggregated particles. Further, the temperature is raised to 56° C., and the aggregated particles are adjusted while confirming the size and the form of the particles with an optical microscope and MULTISIZER II. Next, in order to cause the aggregated particles to coalesce, the pH is increased to 8.0 and the temperature is raised to 67.5° C. After confirming that the aggregated particles coalesce with an optical microscope, the pH is decreased to 6.0 while maintaining the temperature at 67.5° C. After 1 hour, the dispersion is finished heating and is cooled at a temperature decrease rate of 0.1° C./min. Next, the dispersion is repeatedly sieved through a 20 μm mesh and washed with water, followed by drying with a vacuum drying machine. As a result, toner particles are obtained.

Further, the toner particles are heated with a warm air drying machine at 45° C. for 1 hour.

1.5 parts of hydrophobic silica (RY50, manufactured by Nippon Aerosil Co., Ltd.) and 1.0 part of hydrophobic titanium oxide (T805, manufactured by Nippon Aerosil Co., Ltd.) with respect to 100 parts of the heated toner particles are mixed with a sample mill at 10000 rpm for 30 seconds. Next, the mixture is sieved through a vibration sieve having a mesh of 45 μm. As a result, a toner is prepared.

The toner has a volume average particle size of 12.2 μm, an average major axis length of 15 μm, an average thickness of 1.5 μm, and an average circularity of 0.6.

Preparation of Carrier

Ferrite particles (volume average particle size: 35 μm): 100 parts

Toluene: 14 parts

Perfluorooctylethyl acrylate-methyl methacrylate copolymer: 1.6 parts

Carbon black (trade name: VXC-72, manufactured by Cabot Corporation): 0.12 part

Crosslinked melamine resin particles (average particle size: 0.3 μm, toluene insoluble): 0.3 part First, carbon black diluted with toluene is added to the perfluorooctylethyl acrylate-methyl methacrylate copolymer, followed by dispersing with a sand mill. Next, the above-described components other than ferrite particles are dispersed in the above-described dispersion with a stirrer for 10 minutes. As a result, a coating layer-forming solution is prepared. Next, this coating layer-forming solution and the ferrite particles are put into a vacuum degassing kneader and are stirred at a temperature of 60° C. for 30 minutes. Then, toluene is removed by distillation under reduced pressure. As a result, a resin coating layer is formed, and a carrier is obtained.

Preparation of Developer 36 parts of the toner and 414 parts of the carrier are put into a 2 L V-blender, are stirred for 20 minutes, and are sieved through a 212 μm mesh. As a result, a developer is prepared.

Example 1

"700DCP" (manufactured by Fuji Xerox Co., Ltd.) is modified such that a bias applying device is provided between a transfer device and a fixing device. A developer unit is filled with a sample of a developer. In a high-temperature and high-humidity environment of 32° C. and 80% RH, after a toner image is transferred onto recording paper (OK Topcoat+, manufactured by Oji Paper Co., Ltd.), a bias voltage (−400V) is applied to the toner image on the recording paper by the bias applying device under a constant current condition of 50 μA. The toner image on the recording paper is fixed at a fixing temperature of 190° C. and a fixing pressure of 4.0 $kg/cm^2$, and a solid image having a toner applied amount of 4.5 $g/m^2$ is formed on the recording paper. The above-described image is repeatedly formed on 1000 sheets of recording paper.

Comparative Example 1

The solid image is formed with the same method as that of Example 1, except that the bias voltage is not applied before fixing and after transferring.

Example 2

The solid image is formed with the same method as that of Example 1, except that a difference between peripheral speeds of a heating roll and a pressure roll during fixing is 1.03.

Evaluation of Brilliance

The brilliance of the image is evaluated with the following method.

The brilliance of the obtained solid image is evaluated by visual inspection under an illumination for color observation (natural daylight illumination) according to JIS K 5600-4-3: 1999 "Testing methods for paints-Part 4: Visual characteristics of film-Section 3: Visual comparison of the color of paints".

In the evaluation of the brilliance, graininess (glittering brilliance effect) and an optical effect (change in hue depending on the viewing angle) are evaluated, and the evaluation results are expressed by the following five levels. Level 2 or higher is an actually usable level.

Brilliance Level

5: The graininess and the optical effect are in harmony

4: The graininess and the optical effect are slightly exhibited

3: No specific feeling is exhibited

2: The feeling of fogging is exhibited

1: The graininess and the optical effect are not exhibited at all.

In Example 1 in which the bias voltage is applied before fixing and after transferring, the brilliance level is 4. In Comparative Example 1 in which the bias voltage is not applied before fixing and after transferring, the brilliance level is 3. It can be seen from the results that the brilliance is improved by applying the bias voltage before fixing and after transferring.

In Example 2 in which the bias voltage is applied before fixing and after transferring and the heating roll and the pressure roll rotate at different peripheral speeds during fixing, the brilliance level is 5. It can be seen from the result that, by rotating the heating roll and the pressure roll at different peripheral speeds, the brilliance is further improved compared to Example 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image forming unit that forms a latent image on a photoreceptor;

a developing unit that accommodates a developer containing flake shape toner particles and develops the latent image using the developer to form a toner image on a surface of the photoreceptor;

a transfer unit that transfers the toner image formed on the surface of the photoreceptor onto a recording medium;

a bias applying unit that applies a bias voltage to the toner image transferred onto the recording medium such that major axis directions of the flake shape toner particles face substantially the same direction and such that the flake shape toner particles lie along a surface of the recording medium, wherein the bias generating unit generates an electric field having a direction substantially parallel to a transferring direction of the recording medium; and a fixing unit that fixes the toner image to which the bias voltage is applied, wherein the flake shape toner particles have an average major axis length of from 7 μm to 20 μm and an average thickness of from 1 μm to 3 μm and contain a flake shape metallic pigment, and wherein the metallic pigment has an average major axis length of from 5 μm to 12 μm and an average thickness of from 0.01 μm to 0.5 μm.

2. The image forming apparatus according to claim 1, wherein the flake shape toner particles have an average circularity of from 0.5 to 0.9.

3. The image forming apparatus according to claim 1, wherein the fixing unit includes a first roll and a second roll that is arranged opposite to the first roll, the recording medium is nipped between the first roll and the second roll, and the first roll and the second roll rotate at different peripheral speeds and fix the toner image formed on the recording medium while sliding on the toner image.

4. The image forming apparatus according to claim 1, wherein a ratio of a peripheral speed of rotation of the first roll and a peripheral speed of rotation of the second roll is from 0.95 to 1.05.

5. The image forming apparatus according to claim 1, wherein the bias applying unit includes two rolls and forms an electric field between the rolls.

6. The image forming apparatus according to claim 5, wherein a voltage applied to the bias applying unit is in a range of from ±200 to ±500 V.

* * * * *